US010843098B1

(12) United States Patent
Simonsen

(10) Patent No.: US 10,843,098 B1
(45) Date of Patent: Nov. 24, 2020

(54) DYNAMIC BALLOON APPARATUS

(71) Applicant: David Simonsen, Redding, CA (US)

(72) Inventor: David Simonsen, Redding, CA (US)

(73) Assignee: SIMO BALLOONS, LLC, Redding, CA (US)

( * ) Notice: Subject to any disclaimer, the term of this patent is extended or adjusted under 35 U.S.C. 154(b) by 0 days.

(21) Appl. No.: 15/925,273

(22) Filed: Mar. 19, 2018

Related U.S. Application Data

(60) Provisional application No. 62/560,191, filed on Sep. 19, 2017.

(51) Int. Cl.
*A63H 3/06* (2006.01)
*A63H 27/10* (2006.01)

(52) U.S. Cl.
CPC ..... *A63H 27/10* (2013.01); *A63H 2027/1008* (2013.01); *A63H 2027/1041* (2013.01); *A63H 2027/1058* (2013.01); *A63H 2027/1066* (2013.01); *A63H 2027/1075* (2013.01); *A63H 2027/1083* (2013.01)

(58) Field of Classification Search
CPC ..... A63H 27/10; A63H 2027/1008; A63H 2027/1066; A63H 2027/1075
USPC ..... 446/220, 221, 223, 226
See application file for complete search history.

(56) References Cited

U.S. PATENT DOCUMENTS 87,238 A * 2/1869 Bellamy ..... A63H 3/06 446/226
810,690 A * 1/1906 Weiss ..... B64B 1/40 244/33
897,523 A * 9/1908 Cook ..... A63H 5/00 446/200
1,562,625 A * 11/1925 Fife ..... A63H 27/10 446/226
2,952,094 A * 9/1960 Ebel ..... A63H 3/06 446/221
3,952,975 A * 4/1976 Laske ..... A63H 27/08 244/153 R
4,043,554 A * 8/1977 Wolf ..... A63F 9/26 273/459
4,693,695 A * 9/1987 Cheng ..... A63H 1/30 446/220
5,205,062 A * 4/1993 Zimmerman ..... A01K 85/005 43/42.02
5,211,996 A * 5/1993 Zinbarg ..... B65D 33/004 156/61
RE34,401 E * 10/1993 Dudley ..... A63H 3/06 446/221
5,285,898 A * 2/1994 Zinbarg ..... A63H 3/06 206/457
5,288,261 A * 2/1994 Spector ..... A42B 1/206 446/226
5,395,276 A * 3/1995 Valentino ..... A63H 27/10 446/217
5,403,222 A * 4/1995 Koenig ..... A63H 3/06 446/175

(Continued)

*Primary Examiner* — Joseph B Baldori

(74) *Attorney, Agent, or Firm* — Temmerman Law; Mathew J. Temmerman

(57) ABSTRACT

A balloon apparatus utilizing a lighter-than-air portion and an appurtenance attached to the lighter-than-air portion. A connector is selectively linked to the appurtenance and the lighter-than-air portion and manipulates the rotational position of the appurtenance relative to the lighter-than-air portion.

7 Claims, 11 Drawing Sheets

(56) References Cited

U.S. PATENT DOCUMENTS

| | | | | | |
|---|---|---|---|---|---|
| 5,573,439 | A * | 11/1996 | Turner | A63H 3/06 | 446/220 |
| 5,655,325 | A * | 8/1997 | Watkins | G09F 17/00 | 160/243 |
| 5,672,396 | A * | 9/1997 | Zinbarg | A63H 3/06 | 428/12 |
| 6,001,434 | A * | 12/1999 | Zinbarg | A63H 3/06 | 428/12 |
| 6,044,581 | A * | 4/2000 | Shipman | A01M 31/06 | 244/153 R |
| 6,422,914 | B1 * | 7/2002 | Nelson | A63H 27/10 | 248/346.03 |
| 2001/0034176 | A1 * | 10/2001 | Deliu | A63H 27/10 | 446/26 |
| 2003/0045202 | A1 * | 3/2003 | Komar | G09F 21/06 | 446/221 |
| 2004/0157525 | A1 * | 8/2004 | Epstein | A63H 5/00 | 446/220 |
| 2006/0111012 | A1 * | 5/2006 | Machala | A63H 3/06 | 446/226 |
| 2006/0223411 | A1 * | 10/2006 | Burchett | A63H 27/04 | 446/226 |
| 2007/0161322 | A1 * | 7/2007 | Carmon | A63H 27/10 | 446/220 |
| 2014/0148079 | A1 * | 5/2014 | Zhang | A63H 3/06 | 446/226 |
| 2017/0368464 | A1 * | 12/2017 | Publicover | A63H 27/10 | |

* cited by examiner

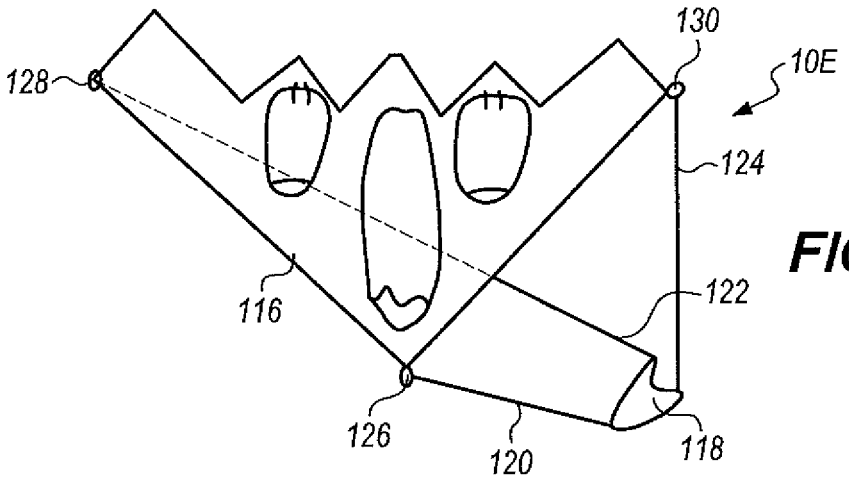
FIG. 10
FIG. 11
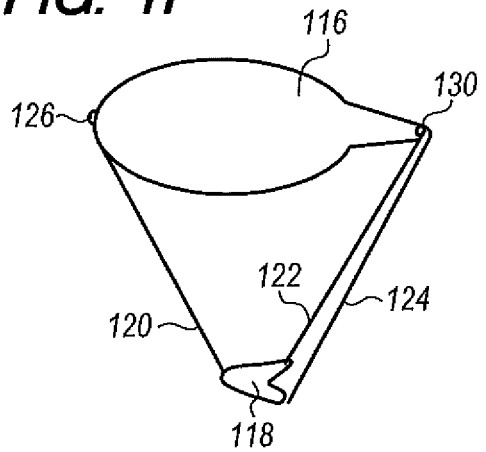
FIG. 12
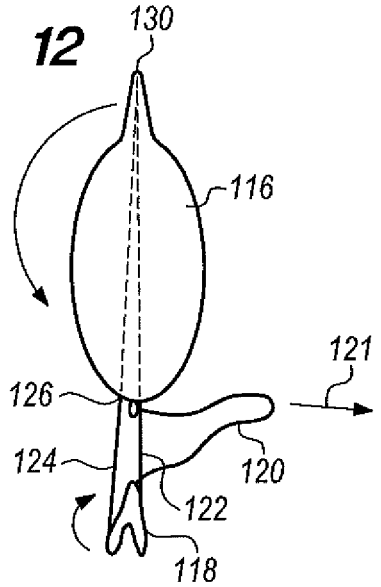
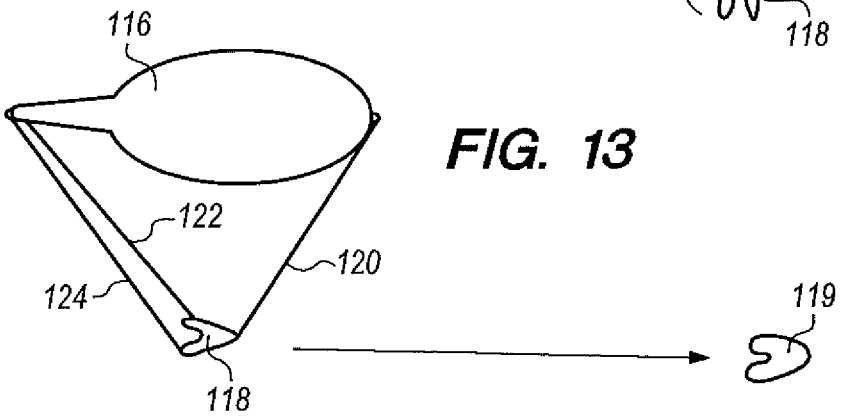
FIG. 13

DYNAMIC BALLOON APPARATUS

CROSS-REFERENCES TO RELATED APPLICATIONS

The present application claims the benefit of U.S. Provisional Patent Application Ser. No. 62/560,191, filed 19 Sep. 2017.

BACKGROUND OF THE INVENTION

The present invention relates to a novel and useful balloon apparatus that includes portions that are dynamically operated via at least one tether in order to change orientation or provide action-like functions of the balloon apparatus.

Balloons are generally treated as objects of amusement and delight. Typically, a balloon consists of a thin elastic or high tensile foil membrane that is filled with a lighter-than-air gas such as helium, hydrogen, and the like.

In the past, balloons have been decorated with designs and characters to mimic animate objects such as animals or persons. Such designs have been applied to the surface of the balloon in a static manner.

A balloon apparatus that provides dynamic features beyond the prior art statically decorated balloons would be a notable advance in the field of toys and gadgets.

SUMMARY OF THE INVENTION

In accordance with the present application, a novel and useful balloon apparatus is herein provided that includes a main lighter-than-air portion and attached moveable appurtenances or sections, that may or may not be buoyant.

A connector, such as a tether line, manipulates the position of the appurtenance relative to the lighter-than-air portion to provide a changed orientation of the balloon apparatus and/or to initiate action-like functions. The tether may also be linked to pulleys, handles, levers, clamps, and the like to affect such dynamic movement of the appurtenance relative to the lighter-than-air portion. Further, mechanical or electrical-electronic noise making and/or light producing devices may also be included in the balloon apparatus in conjunction of the dynamic movement of the appurtenance relative to the lighter-than-air portion. In certain cases, multiple appurtenances may be attached to the lighter-than-air portion, which comprises the main body of the balloon apparatus. Such multiple appurtenances may be articulated relative to one another to create spinning or serpentine movements when positioned in a current of air, such as that provided by the wind.

In addition, the balloon apparatus of the present application may include multiple tethers to allow rotation of the lighter-than-air portion by selective pulling of any one of the multiple tethers. In this manner, various sides of the lighter-than-air portion of the balloon apparatus become visible to the user or other persons on the ground.

Moreover, the lighter-than-air portion may include a swivel-like device to permit the spinning of the lighter-than-air portion relative to the connector or tether.

In other aspects of the balloon apparatus of the present application, the appurtenance may take the form of a flap or flaps having a relatively rigid support. An actuator would then be employed to move the support and any attached flap relative to the lighter-than-air portion to create an image of a person or animal larger in size than the lighter-than-air portion or to convey a message via revealed indicia. Such flap may also comprise an inflatable member that communicates with the lighter-than-air portion once it is deployed.

Another aspect of the present application involves the use of a lighter-than-air portion and appurtenances that are moved relative to the lighter-than-air portion to create a sound which may mimic the sound of a drum, horn, or the like. A handle would be used in certain cases to affect such movement with connection to multiple tethers, pulleys, and swivels.

It may be apparent that a novel and useful balloon apparatus has been hereinabove described.

It is therefore an object of the present application to provide a dynamically operated balloon apparatus that is capable of changing orientation or performing action-like functions when pulling a connector or tether, or tethers, strategically located on the balloon.

Another object of the present application is to provide a dynamically operated balloon apparatus that appears to be motionless and oriented in a standing position that may be transformed into an action orientation when a connector or tether is pulled.

Another object of the present application is to provide a dynamically operated balloon apparatus that is able to rotate, spin, or include portions that exhibit reciprocating movement when one or more tethers are pulled or tensioned.

Another object of the present application is to provide a dynamically operated balloon apparatus that includes a lighter-than-air portion and appurtenances or attached sections that may be filled with lighter-than-air gas to establish flotation, to create an object of neutral buoyancy, or to provide an item that is heavier-than-air.

Another object of the present application is to provide a dynamically operated balloon apparatus that includes appurtenances or attached sections that communicate with the lighter-than-air gas found in the lighter-than-air portion of the balloon apparatus.

Another object of the present application is to provide a dynamically operated balloon apparatus having multiple sections that move relative to the lighter-than-air portion when a tether or connector is operated.

Another object of the present application is to provide a dynamically operated balloon apparatus that provides sufficient buoyancy to carry additional weight added by the user to such apparatus.

Another object of the present application is to provide a dynamically operated balloon apparatus that incorporates attachments to provide noise by the use of open-ended tubes, spinning materials, impacting appurtenances, and the like.

Another object of the present application is to provide a dynamically operated balloon apparatus that is capable of directing light through various locations on the apparatus.

Another object of the present application is to provide a dynamically operated balloon apparatus that achieves buoyancy when a tether or connector is pulled to extend fixed or rotary wings.

Another object of the present application is to provide a dynamically operated balloon apparatus that is capable of changing air suspended orientation or performing action-like functions when a weight is added to a strategic location on the balloon.

The invention possesses other objects or advantages especially as concerns particular characteristics and features thereof which will become apparent as the specification continues.

BRIEF DESCRIPTION OF THE SEVERAL VIEWS OF THE DRAWINGS

FIG. 10 represents another embodiment of the present application in which the lighter-than-air portion of the balloon apparatus is connected to a trio of tethers.

FIG. 11 is a side-elevational view of the balloon apparatus of FIG. 10.

FIG. 12 is a side-elevational view of the balloon apparatus of FIG. 10 in which certain of the tethers are slackened in tension to initiate turning of the lighter-than-air portion by a tensioned tether.

FIG. 13 is a side-elevational view of the apparatus of FIG. 10 where the lighter-than-air portion has been turned opposite to that depicted in FIG. 11.

Figure 1:
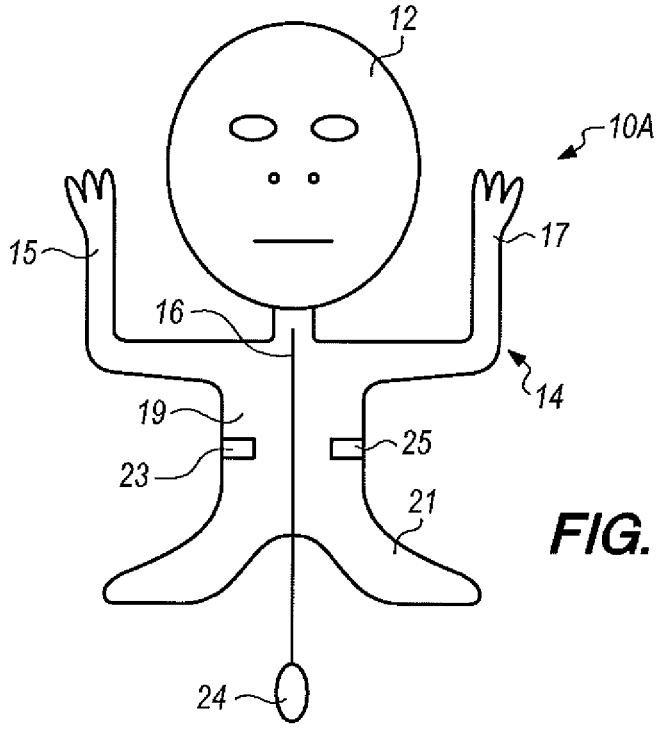
FIG. 1 is a side-elevational view of an embodiment of the balloon apparatus of the present application.

For a better understanding of the application, reference is made to the following detailed description of the preferred embodiments thereof which should be references to the prior described drawings.

DETAILED DESCRIPTION OF THE PREFERRED EMBODIMENTS

Various aspects of the present application will evolve from the following detailed description of the preferred embodiments thereof which should be taken in conjunction with the prior described drawings.

Embodiments of the invention are identified by reference character 10 followed by an upper case letter to denote variations of the same.

With reference to FIG. 1, it may be observed that a balloon apparatus 10A is depicted. Balloon apparatus 10A includes as one of its elements a lighter-than-air or buoyant portion or section 12. Portion 12 includes at least one conventional valve (not shown) for inflation and deflation purposes. This structure is also found in all inflated elements of all the embodiments disclosed herein. Portion 12 is formed in the conventional manner with a thin resilient elastic or high tensile membrane filled with a lighter-than-air gas such as helium, hydrogen, and the like. A non-buoyant section, or appurtenance, 14 is directly or rotatably attached to portion 12 in a flexible manner, specifically about neck 16. A connector or tether 18 selectively links to portion 12 or appurtenance 14 as long as a flexible connection is maintained between the same.

Figure 2:
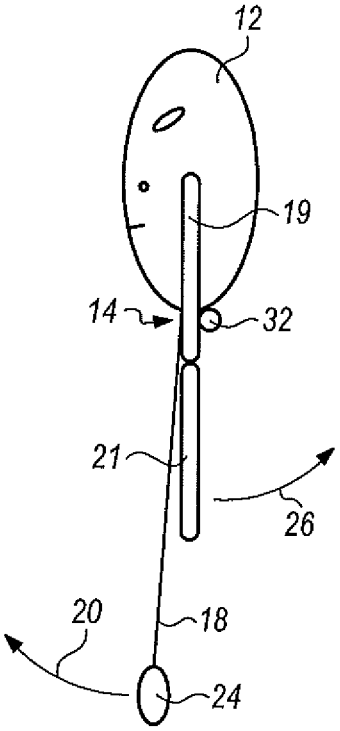
FIG. 2 is a side-elevational view of the apparatus of FIG. 1.
Figure 3:
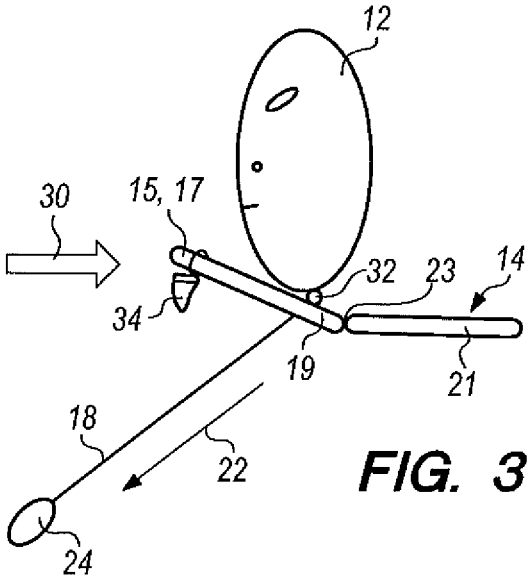
FIG. 3 is a side-elevational view of the apparatus of FIGS. 1 and 2 in which a tether has been pulled or weight has been added to activate a moveable portion.

Referring now to FIGS. 2 and 3 of embodiment 10A, it may be observed that tether or connector 18 is pulled and swung according to directional arrows 20 and 22 of FIGS. 2 and 3, respectively, by the grasping of handle 24. At this point, the relative motion between air and balloon apparatus 10 causes appurtenance 14, in the shape of arms 15 and 17, to rotate upwardly according to directional arrow 26, FIG. 2, which causes the repositioning of appurtenance 14 relative to portion 12 into a roughly perpendicular relationship. Force arrow 30 indicates the direction of moving air which may be the force of wind. A stop 32 located between portion 12 and appurtenance 14 stabilizes the position of appurtenance 14 relative to portion 12, as shown in FIG. 3, once rotation of appurtenance 14 takes place. Stop 32 may also take the form of a tube that emits a whistle when air passes over apparatus 10A. In certain cases, stop noise maker 32 may include a battery-operated speaker with recorded messages.

Moreover, appurtenance 14 of embodiment 10A may be formed into two parts 19 and 21 that move relative to each other at recesses 23 and 25. The movement of sections 19 and 21 relative to one another is attenuated or stopped by contact between sections 19 and 21 at area 23. Such attenuations may also occur by the contact between section 19 and lighter-than-air portion 12 in place of stop 32.

It should also be noted that a pouch 34 may be placed on balloon appurtenance 14 of embodiment 10A. Pouch 34 may be filled with a weight which may be edible treats, such as candy, and may cause the rotation of appurtenance 14 relative to portion 12, depending on the location of the pouch 34 and buoyant force exerted by portion 12. To attach pouch 24 to arms 15 and 17, arms 15 and 17 are held together. Pouch 34 is then employed to hold arms 15 and 17 together. Weight is subsequently added to pouch 34. Of course, and alternate tie and weight may be used in place of weighted pouch 34. In any case, the addition of pouch 34 to apparatus 10A will cause appurtenance 14, the non-buoyant section, to move quickly to the horizontal position (depicted in phantom in FIG. 3).

Figure 3A:
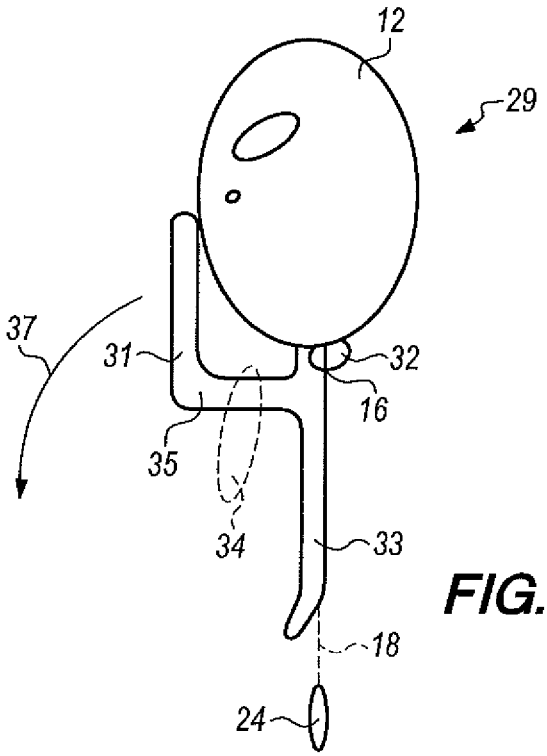
FIG. 3A is a side elevational view of the apparatus of the present application.
Figure 3B:
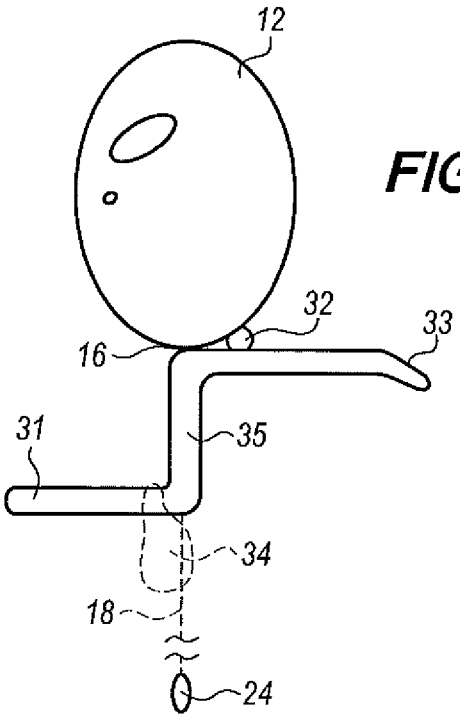
FIG. 3B is a side elevational view of the apparatus FIG. 3A after movement of a part thereof.

Viewing now FIGS. 3A and 3B, apparatus 29, a variation of embodiment 10A, is shown. The common elements between embodiment 10A of FIGS. 3A and 3B bear identical reference characters. Notably, elongated lighter-than-air attachment in the form of arm 31 and body portion 33 are offset by an intermediate portion 35. When weight pouch 34 is connected to intermediate portion 35, rotation of arm 31 and body portion 35 will take place, directional arrow 37 of FIG. 3A. Arms 31 and body portion 33 will then assume a horizontal configuration without the influence of moving air, FIG. 3B. Optional noise maker stop 32 will hold arms 31 and body portion 33 in such horizontal configuration by contact with body portion 33. Absent noise maker stop 32, arm 31, and body portion 33 attain a horizontal orientation via contact between lighter-than-air portion 12 and body portion 33. Neck 16 would be shortened in this instance.

Figure 4:
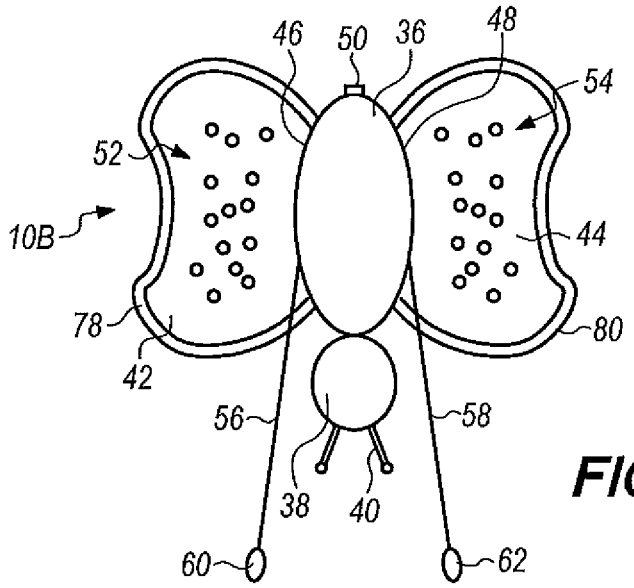
FIG. 4 is a bottom plan view of another embodiment of the balloon apparatus of the present application.
Figure 5:
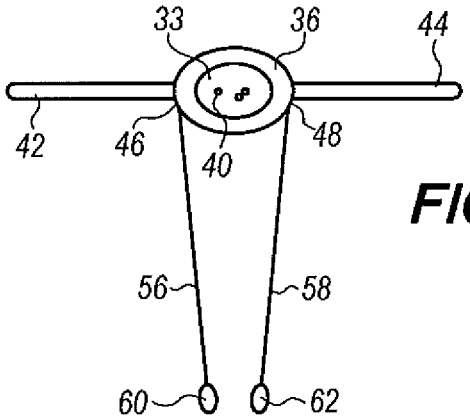
FIG. 5 is a front-elevational view of the apparatus of FIG. 4.
Figure 6:
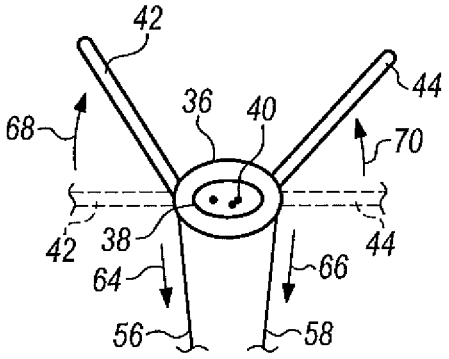
FIG. 6 is a front-elevational view of the apparatus of FIG. 4 illustrating movement of the same when tethers are pulled downwardly.
Figure 7:
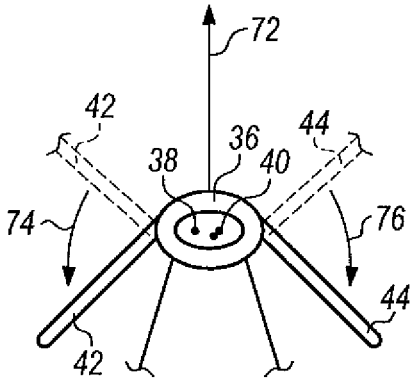
FIG. 7 is a front elevational view of the apparatus of FIG. 4 illustrating movement when the tethers are untensioned.

With reference to FIGS. 4-7, another embodiment 10B of the balloon apparatus of the present application is depicted. Embodiment 10B includes a lighter-than-air portion 36 and connected buoyant portion 38 and non-buoyant portion 40. Subsections 42 and 44 flexibly or rotatably attach to portion 36 along seams or channels 46 and 48. Valve 50 permits the inflation or deflation of balloon apparatus 10B. Plurality of pockets 52 and 54 within subsections 42 and 44, respectively, provide a three-dimensional appearance and diminish restriction of movement of subsections 42 and 44 along seams 46 and 48. A pair of tethers 56 and 58, having handles 60 and 62, respectively, attach to lighter-than-air portion 36. The exertion of force on either tether 56 or 58 will cause balloon apparatus 10B to tilt. However, as depicted in FIGS. 4 and 5, balloon apparatus 10B appears to be horizontally coasting or gliding. With reference to FIGS. 6 and 7, when tethers 56 and 58 are pulled downwardly, as depicted in FIG. 6 by directional arrows 64 and 66, subsections 42 and 44 rotate upwardly, directional arrows 68 and 70, respectively. Likewise, as shown in FIG. 7, release of tethers 56 and 58 will allow portions 36, 38, and 40 to travel upwardly, directional arrow 72, causing subsections 42 and 44 to rotate downwardly, directional arrows 74 and 76. The gist of FIGS. 6 and 7 is that the apparatus 10B, which is in the form of a flying animal having a body and head portion composed of portions 36, 38, and 40, appears to be flying, since subsections 42 and 44 mimic wings of such flying animal. Rigid perimeters 78 and 80 are inflated bodies that communicate with the gaseous interior of lighter-than-air portion 36. Rigid perimeters 78 and 80 of subsections 42 and 44 maintain the somewhat planar integrity of subsections 42 and 44 when sections 42 and 44 are generally horizontal, as illustrated in FIG. 5.

Figure 8:
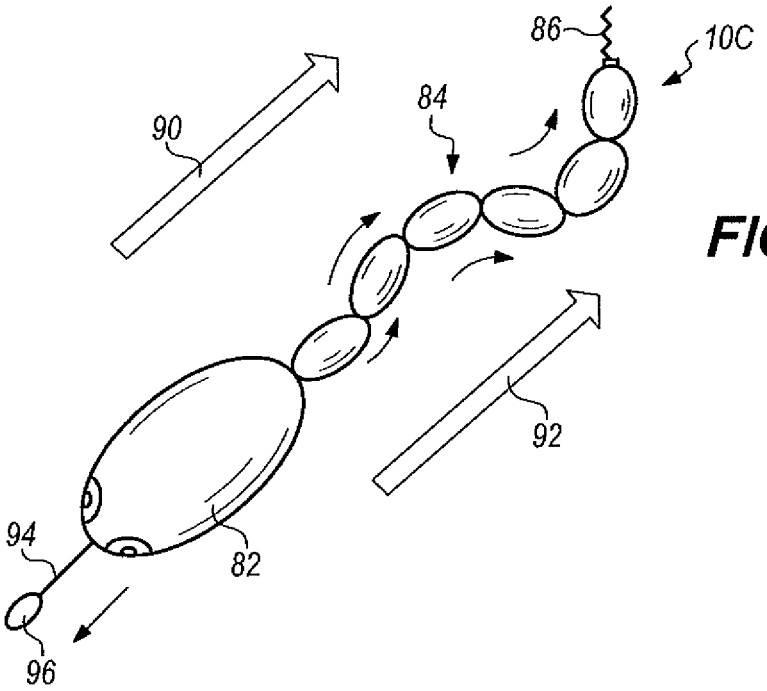
FIG. 8 represents another embodiment of the present application showing an articulated structure.

Turning now to FIG. 8, it may be observed that balloon apparatus 10C of the present application is shown having a main lighter-than-air portion 82 and including a plurality of smaller lighter-than-air portions 84 connected thereto. It should be noted that portion 82 and multiplicity of portions 84 may be interconnected such that inflation of the same through valve or tie-off 86 inflates main portion 82 and multiplicity of portions 84. In other cases, portion 82 and multiplicity of portions 84 may comprise independently inflated bodies. In addition, multiplicity of portions 84 are flexibly connected to main portion 82 and to one another such that air passing beside balloon apparatus 10C, arrows 90 and 92, cause balloon apparatus 10C to wiggle or snake through the air when pulled by tether 94 via handle 96. In certain cases, plurality of sections 84 may be of neutral buoyancy rather than having positive buoyancy. Of course, the number of multiplicity of portions 84 may be determined as desired.

Figure 9:
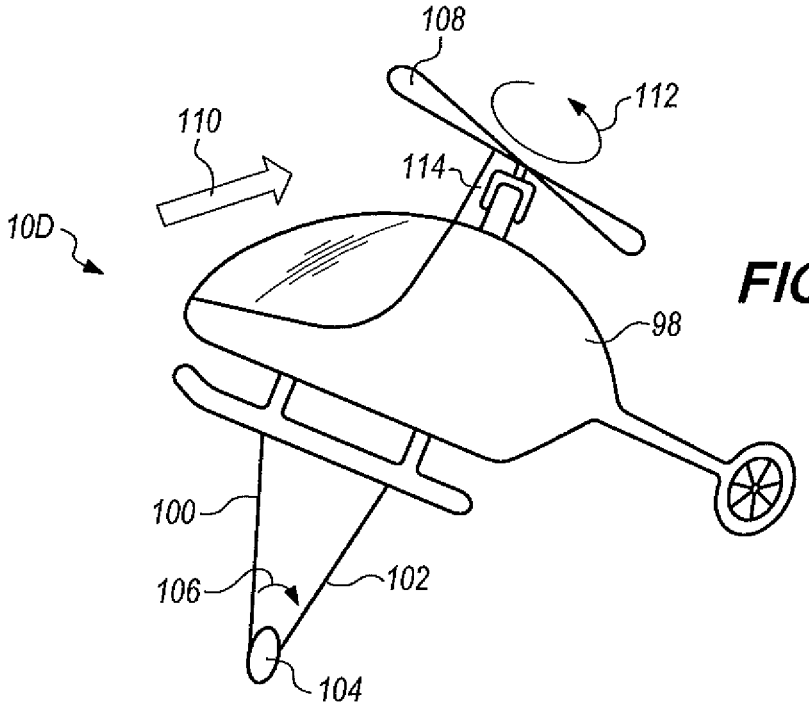
FIG. 9 is another embodiment of the present application showing the use of a spinning portion relative to a main lighter-than-air portion.

With reference to FIG. 9, another embodiment 10D of the present application is depicted in which balloon apparatus includes a main lighter-than-air portion 98 in the form of a helicopter. A pair of tethers 100 and 102 can tilt main portion 98 forward or backward or side-to-side by the movement of handle 104. As shown in FIG. 9, handle 104 is tilted main portion 98 slightly clockwise, directional arrow 106. A propeller 108, connected to the top area of lighter-than-air portion 98, freely spins when impacted by air movement shown by force arrow 110. As tilted in FIG. 9, propeller 108 spins in the direction indicated by arrow 112. However, when portion 98 is tilted in an opposite counterclockwise direction, propeller 112 will spin in the opposite direction. Propeller 108 may be attached to buoyant portion 98 by mechanical means such as the use of glue or Velcro fasteners. In other words, propeller 108 rotates independently of buoyant portion 98 of balloon apparatus 10D. In addition, a flexible flange 114 extends from propeller 108 and creates a beating noise against buoyant portion 98 to mimic noise generated by an actual helicopter.

FIGS. 10-13 illustrate another embodiment 10E of the balloon apparatus of the present application. Apparatus 10E is provided with a main lighter-than-air portion 116, which is formed into the shape of a miniature military bomber. Handle 118 connects to tethers 120, 122, and 124. Likewise, tethers 120, 122, and 124 link to rings 126, 128, and 130, formed at the extremities of portion 116. Balloon apparatus 10E, in its static state, FIGS. 10 and 11, appears to be an aircraft waiting to take off or one that is hovering. By pulling tether 120 through taut tethers 122 and 124, directional arrow 121, balloon apparatus 10E appears to be in a downwardly oriented state, FIG. 12. Further movement of tether 120 inverts or turns upside down balloon apparatus 10E, as shown in FIG. 13. Handle 118 may be employed by the user to mimic the motion of portion 116 or to possess a toy-like structure interactive with portion 116. If handle 118 is removed to serve as a toy 119, a weight must be retained instead with linkage to tethers 120, 122, and 125 to comply with government regulations.

Figure 14:
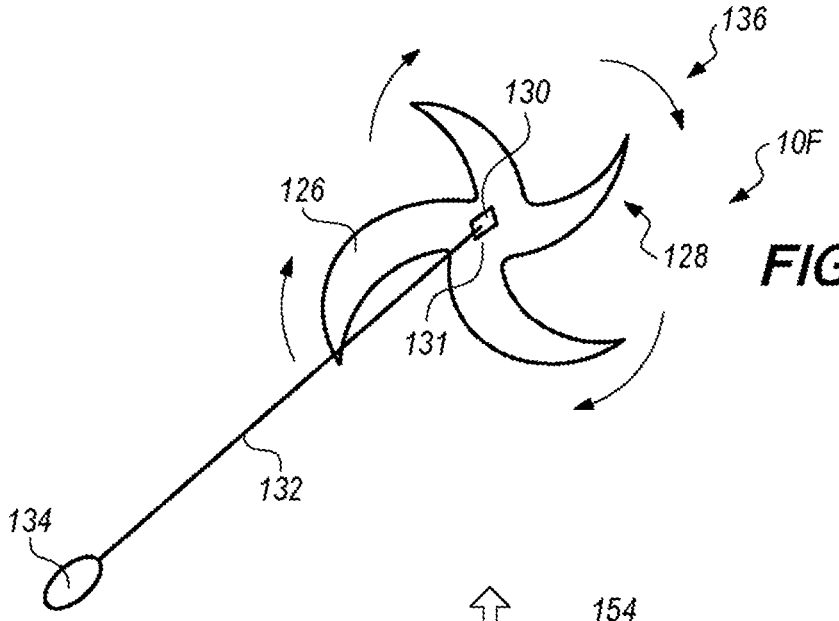
FIG. 14 represents another embodiment of the balloon apparatus of the present application showing a lighter-than-air portion in the form of a rotating member.
Figure 15:
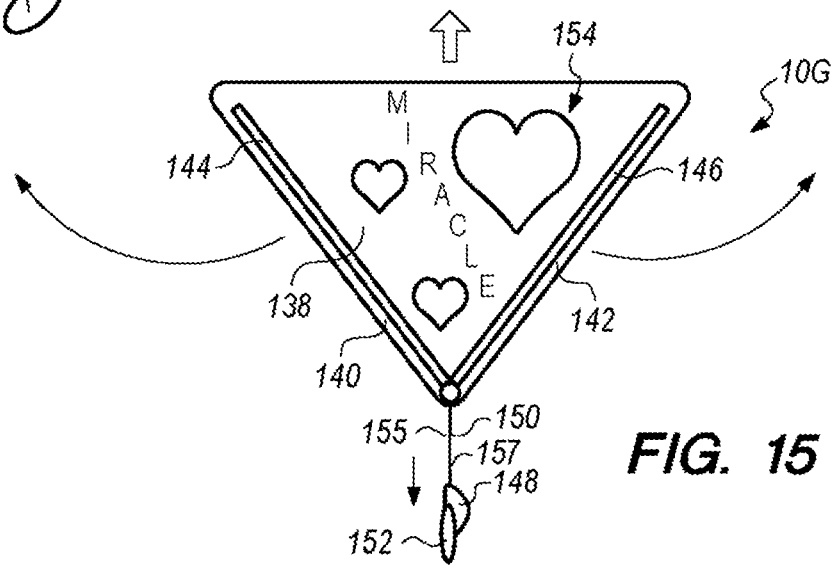
FIG. 15 illustrates a front-elevational view of another embodiment of the present application having compressed flaps.
Figure 16:
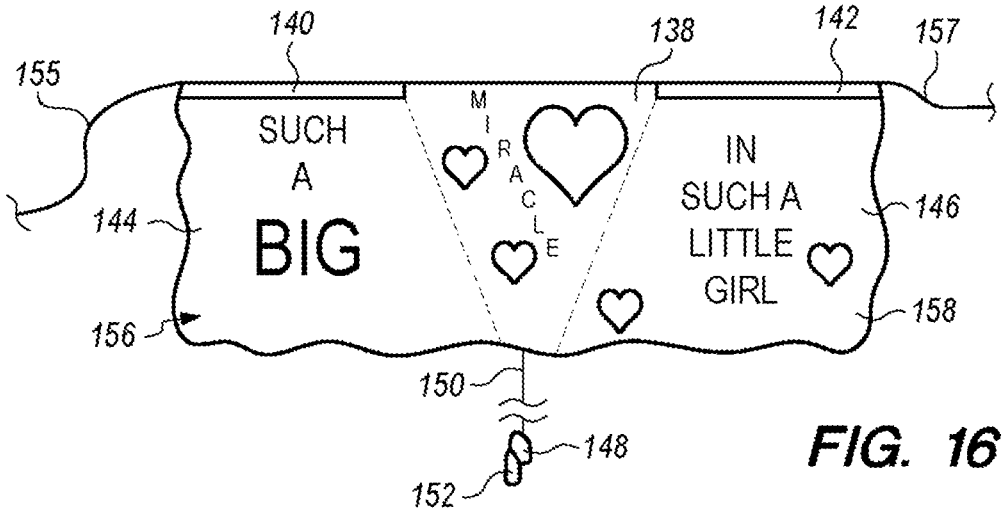
FIG. 16 is a front-elevational view of the embodiment of FIG. 15 with extended flaps.

FIG. 14 illustrates another embodiment 10F of the balloon apparatus of the present application in which a lighter-than-air portion 126 includes a plurality of sickle-shaped arms 128, although a single sickle-shaped arm would suffice. Each sickle-shaped arm of plurality of sickle-shaped arms 128 may take the shape of an animate figure, such as an animal, person, and the like. A swivel 130 at the central area 131 of buoyant portion 126 connects to a tether 132 which extends to a handle 134. Central area 131 may be convex-shaped. When tether 132 is slightly relaxed, portion 126 will appear to be floating or hovering in a horizontal position. As soon as tether 132 is pulled or tensioned by the wind, portion 126 will move to a semi-vertical position and begin to rotate according to multiplicity of directional arrows 136. Of course, the greater tensioning of tether 132 will cause faster rotation of portion 126. Omission of swivel 130 will permit rotation of portion 126, and counter-rotation of portion 126 when tether is slackened FIGS. 15 and 16 represent embodiment 10G of the balloon apparatus of the present invention. Apparatus 10G includes a lighter-than-air portion 138 having a roughly triangular cross-sectional configuration. Arms or supports 140 and 142 are rotatably affixed to portion 138 and include flaps 144 and 146 attached thereto. Arms 140 and 142 are inflated via portion 138. As shown in FIG. 15, flaps 144 and 146 are folded or squeezed between main portion 138 and arms or supports 140 and 142, and held in that position by a clip or clamp 148. Spooled-up tether 150, and auxillary tethers 155 and 157 are also compressed within clamp 148. Clamp 148 is part of handle 152. Flaps 144 and 146 may include chambers that also communicate with the gaseous interior or chamber of portion 138 such that removal of clamp 148 allows a portion of 138 to float upwardly. Arms 140 and 142 expand with flaps 144 and 146 to a position shown in FIG. 16 adjacent portion 138 when portion 132 reaches the end of the length of tether 150. Such expansion also may include inflation of flaps 144 and 146 to a certain degree and the freeing of auxiliary tethers 155 and 157. As may be seen, indicia 154 on portion 138 indicate a portion of a message. Once arms 140 and 142 with connected flaps 144 and 146 are extended, a complete message is conveyed through the indicia 156 and 158 on flaps 144 and 146, respectively. Of course, arms or supports 140 and 142 with flaps 144 and 146 may be returned to their position as shown on FIG. 15 for storage. Secondary tethers 155 and 157 extend from arms 140 and 142. Balloon apparatus 10G is intended to be a "greeting card" balloon to indicate gender reveals, baby births, retirements, graduations, celebrations, events, and other special occasions. In addition, noise makers such as that found on embodiment 10A of FIGS. 1-3 may be included in embodiment 10G.

Figure 17:
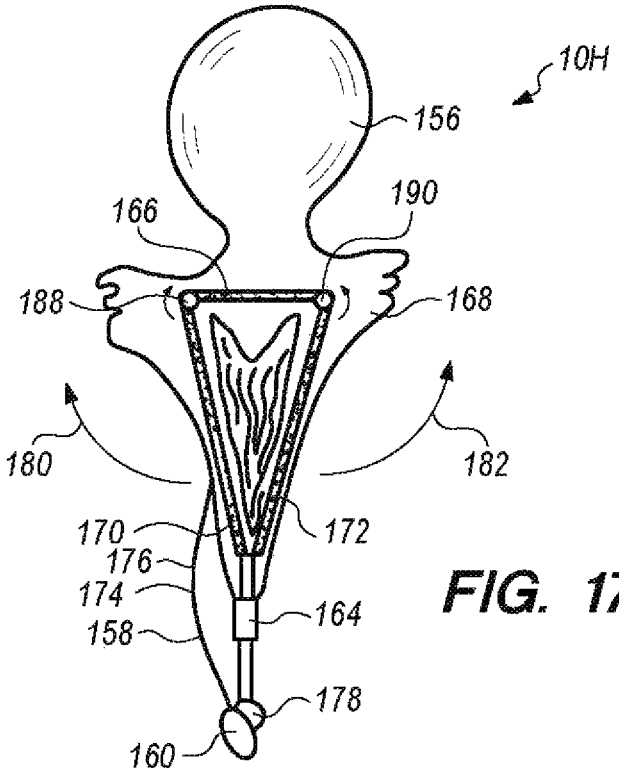
FIG. 17 shows a rear-elevational view of another embodiment of the present application.
Figure 18:
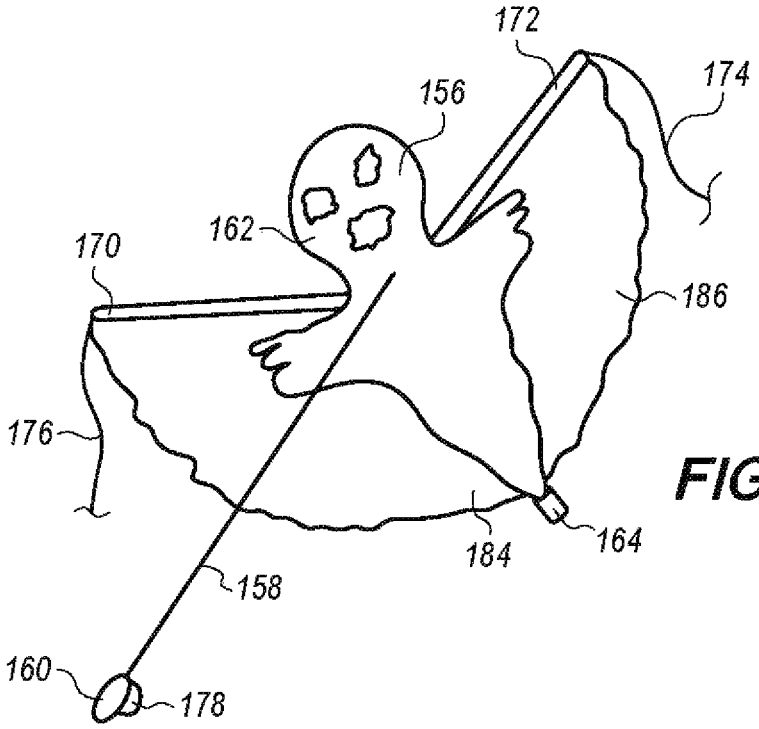
FIG. 18 is a front-elevational view of the embodiment of the balloon apparatus of FIG. 17 with extended flaps.

Referring now to FIGS. 17 and 18, yet another embodiment 10H of the present application is depicted. Embodiment 10H shows a lighter-than-air portion 156. The front surface 162 of portion 156 includes the rendition of the body and head of a flying animal such as a bird, FIG. 18. Valve 164 permits inflation or deflation of the same. A bar 166 is fastened to the rear surface 168 of buoyant portion 156. Rotatable tubes 170 and 172, filled with buoyant gas, are rotatably attached to bar 156, FIG. 17. Tethers 174 and 176 are attached to the end of tubes 170 and 172 and tether 158 and are held there by a clamp 178. Once clamp 178 is released, tubes 170 and 172 rotate outwardly according to directional arrows 180 and 182, FIG. 17, such that tubes 170 and 172 fully expand into the position shown on FIG. 18. Flaps 184 and 186 also then fully expanded to represent wings of the body of the animal shown by buoyant portion 156, which has simultaneously floated. Pivots 188 and 190 allow the rotational movements of tubes 170 and 172 relative to bar 166, FIG. 17. It should be noted that embodiment 10H operates similarly to embodiment 10G.

Figure 19:
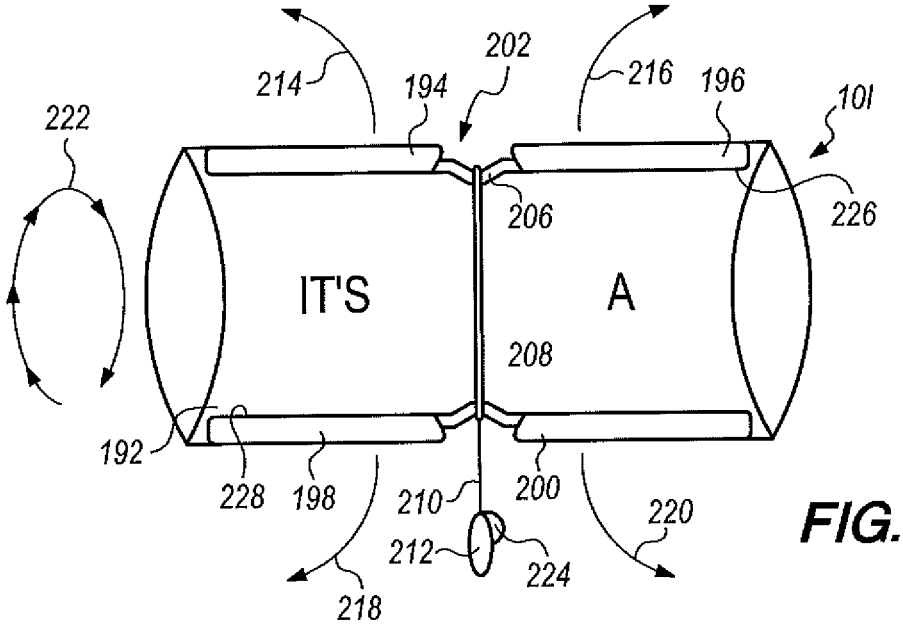
FIG. 19 is a front elevational view of another embodiment of the present application.
Figure 20:
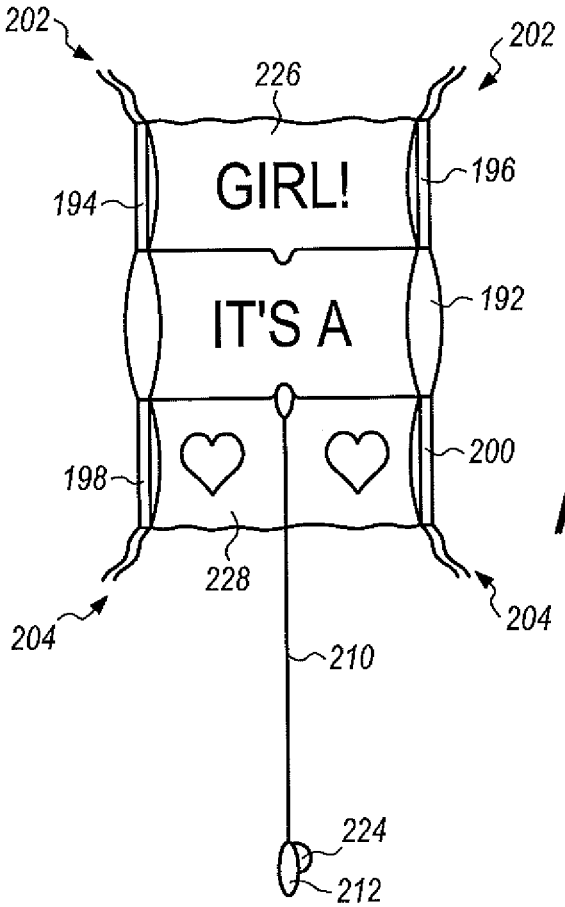
FIG. 20 is a front-elevational view of the embodiment of FIG. 19 with extended flaps.

FIGS. 19 and 20 represent another embodiment 10I of the present invention. The balloon apparatus of embodiment 10I includes a main lighter-than-air portion 192. Rotatably connected to portion 192 are inflated tubes or arms 194, 196, 198, and 200. Needless to say, inflated arms 194, 196, 198, and 200 are filled with lighter-than-air gas, such as helium, hydrogen, and the like. Ties or straps 202 and 204 hold inflated arms 194, 196, 198, and 200 at a position adjacent inflatable portion 192. Ties 202 and 204 include releasable knots 206 and 208. A tether 210 extends up and around inflatable portion 192 such that releasing tether 210 via handle 212 releases knots 206 and 208 allowing inflated arms 194, 196, 198, and 200 to pivot outwardly according to directional arrows 214, 216, 218, and 220, respectively. Portion 192 rotates in a 360° path since tether 210 extends up and around portion 192 to the side opposite that shown on FIG. 19. Directional arrows 222 indicate this 360° movement. The release of tether 210 is affected by the removal of clamp 224. Flap 226 connected to arms 194 and 196, and flap 228 connected to arms 198 and 200, are then exposed. A message initially only found on portion 192 is then completed by the messages found on flaps 226 and 228.

Figure 21:
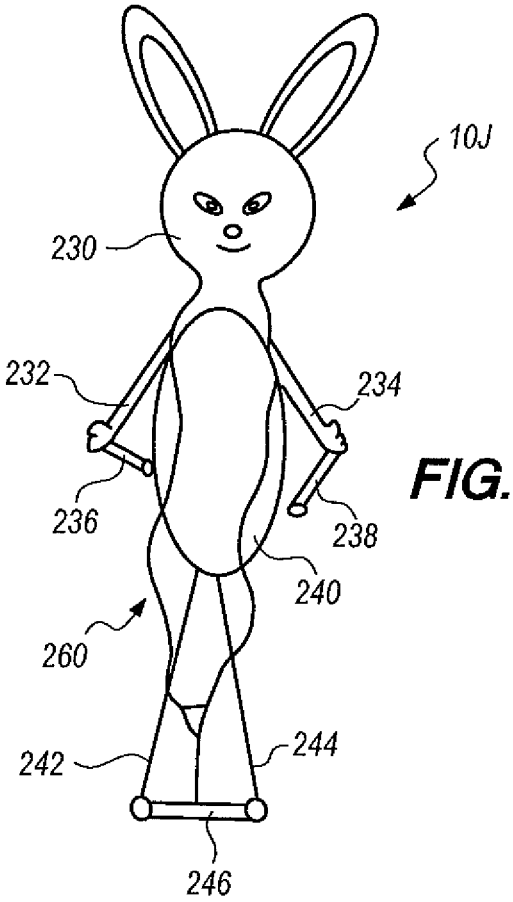
FIG. 21 is a front-elevational view of yet another embodiment of the balloon apparatus of the present application.
Figure 22:
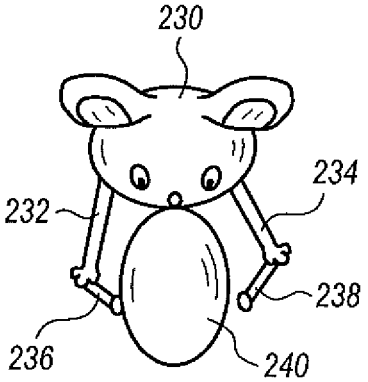
FIG. 22 is a top-pan view of the embodiment of the balloon apparatus of FIG. 21.
Figure 23:
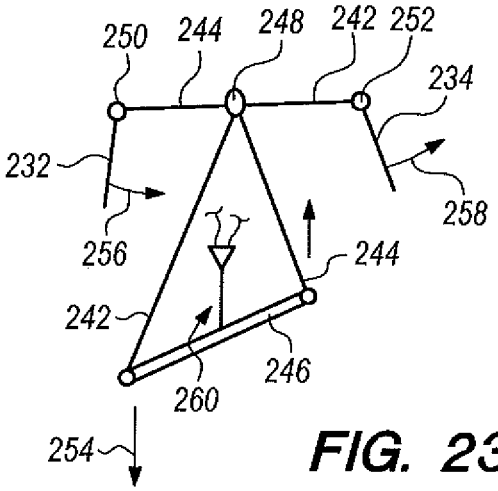
FIG. 23 represents a schematic of the mechanism employed to move portions of the balloon apparatus of FIGS. 21 and 22.

In viewing FIGS. 21-23, it may be observed that another embodiment 10J of the balloon apparatus of the present application is shown. Balloon apparatus 10J includes a lighter-than-air portion 230 having relatively rigid arms 232 and 234 pivotally connected thereto. In the present case, these elements resemble a rabbit. Beating sticks 236 and 238 connect to arms 232 and 234, respectively. An additional lighter-than-air section 240 extends from portion 230. Control lines 242 and 244 connect to a handle 246. FIG. 23 shows the mechanism involved with animating beating sticks 236 and 238 where control lines 242 and 244 run through a pulley 248 that extends to pivots 250 and 252. Thus, the canting of handle 246 will cause either beating stick 236 or 238 to hit or contact inflatable portion 240 to make a drumming sound. As shown in FIG. 23, handle has been moved according to directional arrow 254 to cause arms 232 and beating stick 236 to contact additional inflatable portion 240. Directional arrows 256 and 258 indicate the movement of arms 232 and 234 in this regard. Accordingly, canting handle 246 in the opposite direction will cause beating stick 238 to contact inflatable portion 240 and move beating stick 236 away from inflatable portion 240. Tether lines 260 are used to hold inflatable portion 230 and are also connected to handle 246.

Figure 24:
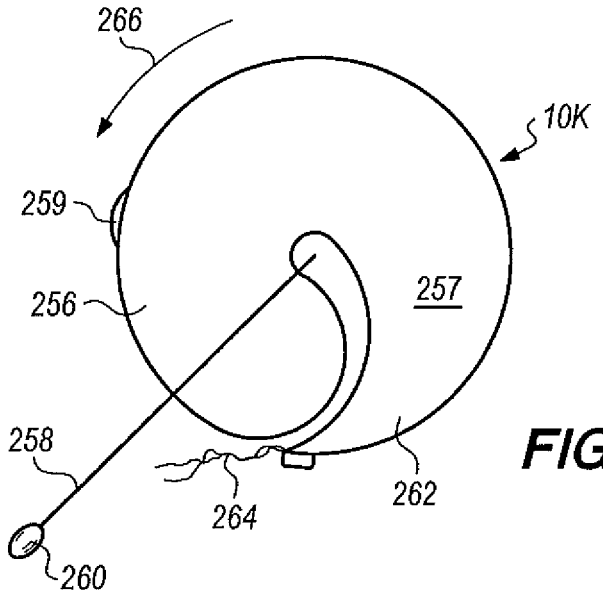
FIG. 24 is a front elevational view of another embodiment of the present application.

With further reference to FIG. 24, another embodiment 10K of the apparatus of the present application is illustrated. Balloon apparatus is 10K possesses a lighter-than-air portion 256 connected on side 257 to tether 258 having weighted handle 260. Apparatus 10K is constructed with a sickle-shaped end section 262 of portion 256. Weight 259 may be added to portion 256 for balance. Streamer 264 trails from the end of section 262. A noise maker 263, such as a tube whistle, is also ideally positioned at the end of section 262. Air passing over portion 256 follows the contour of section 262 exerting an increasing force on the end of sickle 262, causing rotation of portion 256, directional arrow 266. When tether 258 is positioned on the side opposite to side 257 (not shown), rotation of portion 256 will reverse from that indicated by directional arrow 266.

Figure 25:
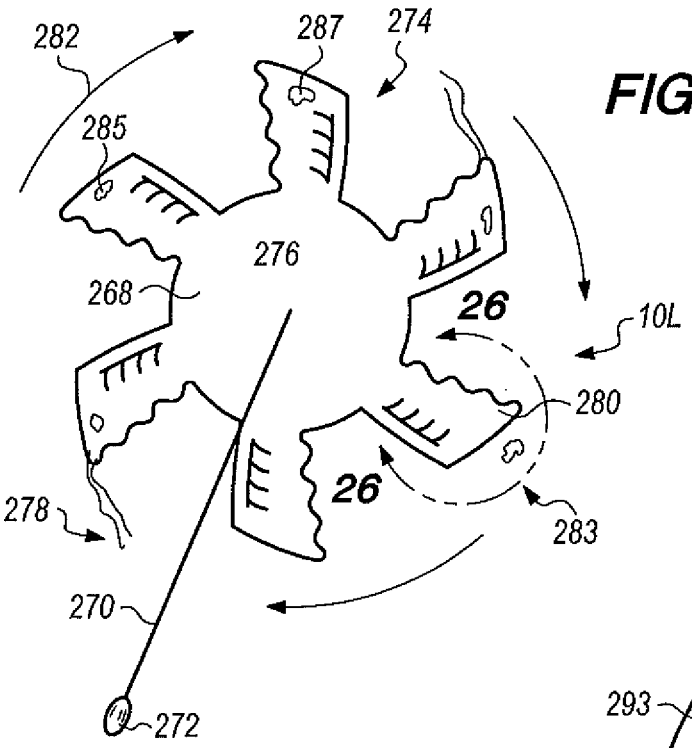
FIG. 25 is a front elevational view of another embodiment of the present application.
Figure 26:
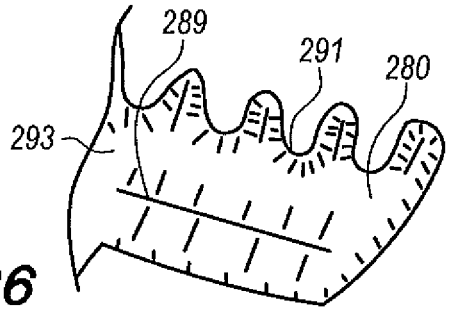
FIG. 26 is a partial magnified view of an arm of the embodiment of FIG. 25, taken along line 26-26 thereof.

Viewing now FIGS. 25 and 26, another embodiment 10L of the apparatus of the present application is revealed. Balloon apparatus 10L includes a lighter-than-air portion 268 held by tether 270 with weighted handle 272. Plurality of arms 274 extend from a convex or concave central surface portion 276 of lighter-than-air portion 268. Streamers, noise makers, lights, and the like may append from the ends of any of plurality of arms 274. As depicted, pair of streamers 278 are shown. Noise makers may also be positioned at the ends of arms 274, which move at a higher velocity than central portion 276. Exemplary arm, 280, FIG. 26, shows a complex geometry of arm 280 having convex surface area 289 and concave surface area 291. Such structure of increased surface area on side 293 of arm 280 causes the balanced or unbalanced rotation of portion 268 as desired. The underside of arm 280 exhibits the same contours as side 293 (not shown). In other words, air is trapped and directed to plurality of arms 274 from convex or concave central surface portion 276 of lighter-than-air portion 268, causing such rotation, directional arrows 282. A multiplicity of images 238 may be applied to plurality of arms 274 to create a viewable animation when arms 274 spin. Exemplary images 285 and 286 are noted on FIG. 25.

Figure 27:
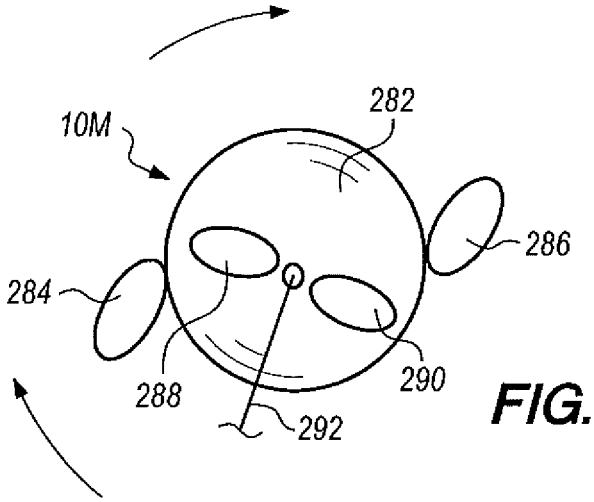
FIG. 27 is a front view of another embodiment of the present application.
Figure 28:
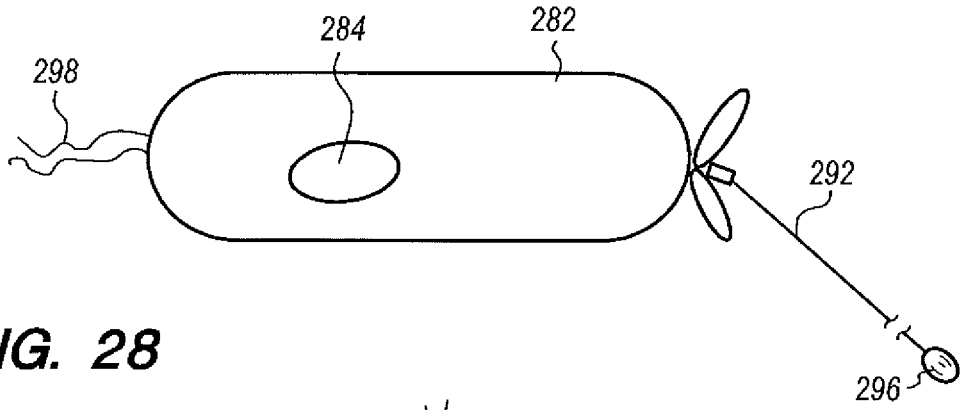
FIG. 28 is a right side elevational view of the embodiment of FIG. 27.
Figure 29:
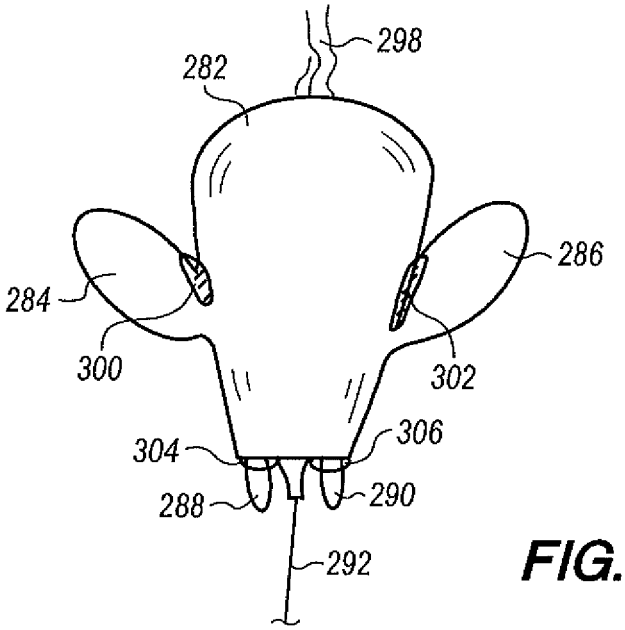
FIG. 29 is a top plan view of the embodiment of FIG. 27.

With reference to FIGS. 27-29, embodiment 10M of the apparatus of the present application is shown. Balloon apparatus 10M possesses a main tapered lighter-than-air portion 282 having side fins 284 and 286 which communicated with the interior of portion 282. The front part 283 of portion 282 possesses a smaller girth than rear part 285. Front fins 288 and 290 project from portion 282. Tether 292 connects to portion 282 via swivel 294 and terminates in weighted handle 296. Streamers 298, as well as noise makers and the like, extend from portion 282. It should be realized that streamers may attach to any of the embodiments 10A-10L of the present application. Reinforced areas 300, 302, 304, and 306 add to the sturdiness of apparatus 10M, and may be formed by sealing the envelope of balloon apparatus 10M to itself. Of course, other sealing devices may be used such as adhesives, and the like. Such structure provides improved positioning of fins 284 and 286 to control airflow and promote spinning. Apparatus 10M rotates according to directional arrows 308, FIG. 27. Rotation of apparatus 10M is reversed by interchanging fins 284 and 286. Also, the positioning of fins 284 and 286 adjacent each other and/or the positioning of fins 288 and 290 adjacent each other, toward one side of portion 282 would further induce the spinning of embodiment 10M. In addition, the tapering of portion 282 increases the fluid pressure on side fins 284 and 286 in moving air which further biases the spinning of apparatus 10M.

In operation, the user performs a method of operating a toy by providing a balloon, providing an attachment to the balloon, and initiating an actuator to move the attachment relative to the balloon. The actuator may take the form of a tether. In addition, initiation of the actuator may also include the step of inflating the attachment with lighter-than-air gas.

While in the foregoing embodiments of the application have been set forth in considerable particularity for the purposes of making a complete disclosure of the invention, it may be apparent to those of skill in the art that numerous changes may be made in such details without departing from the spirit and principles of the application.

I claim:

1. A method of operating a toy, comprising:

providing a balloon with a balloon main portion having a first indicia thereon;

providing an attachment to said balloon, said attachment comprising two arms and one or more flaps connected thereto, the flaps folded in a folded configuration between the balloon main portion and balloon arms such that a second indicia is initially concealed;

providing a clamp that holds said arms and flaps in said folded configuration, and which compresses a tether and auxiliary tethers;

releasing said clamp to free only said auxiliary tethers, thereby causing said arms and flaps to move relative to said balloon;

whereby the movement of said arms and flaps reveals the second indicia.

2. The method of claim 1 in which said tether is linked to said arms.

3. The method of claim 1 further comprising the step of inflating said arms with gas prior to said step of releasing said clamp and creating a noise by causing said arms to contact said balloon following said step of initiating an actuation.

4. The method of claim 1 in which said clamp is part of a handle.

5. The method of claim 4 whereby said arms include chambers in gaseous communication with the balloon main portion such that removal of the clamp allows the pivoting movement of said arms.

6. A method of operating a toy, comprising:

providing a balloon having a balloon main portion;

providing an elongated lighter-than-air attachment rotatably connected to said balloon, the attachment tied in position adjacent said main portion by a tie connected to a tether extending around said portion;

a clamp securing said tether;

releasing said clamp, which releases said tether, which in turn releases said tie, thereby allowing said attachment to pivot in a 360 degree movement relative to the balloon main portion;

stopping said rotation of said lighter-than-air portion in a predetermined position; and wherein said attachment further comprises at least one attachment flap, and wherein said main portion has a first message thereon, and the pivoting of said attachment reveals a second message on said at least one attachment flap.

7. The method of claim 6 wherein said clamp is part of a handle.

* * * * *